US007991318B2

(12) United States Patent
Tamura et al.

(10) Patent No.: US 7,991,318 B2
(45) Date of Patent: Aug. 2, 2011

(54) IMAGE FORMING APPARATUS

(75) Inventors: Nobuyasu Tamura, Hachioji (JP); Yutaka Miyasaka, Machida (JP); Kazutoshi Kobayashi, Hachioji (JP)

(73) Assignee: Konica Minolta Business Technologies, INc., Tokyo (JP)

( * ) Notice: Subject to any disclaimer, the term of this patent is extended or adjusted under 35 U.S.C. 154(b) by 539 days.

(21) Appl. No.: 12/184,453

(22) Filed: Aug. 1, 2008

(65) Prior Publication Data

US 2009/0060560 A1 Mar. 5, 2009

(30) Foreign Application Priority Data

Sep. 5, 2007 (JP) ..... 2007-229935

(51) Int. Cl.
*G03G 21/20* (2006.01)

(52) U.S. Cl. ..... 399/92; 399/99; 399/274; 399/284

(58) Field of Classification Search ..... 399/92, 399/99, 119, 274, 284, 286
See application file for complete search history.

(56) References Cited

U.S. PATENT DOCUMENTS 6,377,769 B2 * 4/2002 Kakimoto ..... 399/284

FOREIGN PATENT DOCUMENTS

JP 11-327295 A 11/1999

* cited by examiner

*Primary Examiner* — Hoang Ngo
(74) *Attorney, Agent, or Firm* — Holtz, Holtz, Goodman & Chick, PC

(57) ABSTRACT

An image forming apparatus includes an image carrier, a developer carrier arranged to face the image carrier to form a developing nip portion, which carries developer containing toner for developing a latent image formed on the image carrier, a developing unit having a developer regulating member that regulates a thickness of a layer of the carried developer, an air sending duct having an air sending path provided on the developing unit, which sends air to the developer carrier and a suction duct having a suction path provided on the developing unit, which sucks air from the developer carrier. The developer regulating member is arranged on an air sending duct side, and the air sending and suction paths are arranged to be connected by forming a space surrounded by a surface of the developer carrier, the developer regulating member and a wall forming the suction path.

3 Claims, 3 Drawing Sheets

IMAGE FORMING APPARATUS

This application is based on Japanese Patent Application No. 2007-229935 filed on Sep. 5, 2007, which is incorporated hereinto by reference.

BACKGROUND OF THE INVENTION

The present invention relates to an image forming apparatus having therein a developing unit relating to image forming conducted by a copying machine of an electrophotographic type, a printer and a facsimile machine.

In recent years, the amount of toner used has been increased by spread of colorization and speeding up of an image forming apparatus, and thereby, members in the apparatus relating to image forming are soiled by scattered toner to increase frequency of adverse effects on image quality.

As a measure to solve this problem, there is disclosed a method wherein suction duct (scattering duct) 544 that sucks scattered toner and exhaust duct (air sending duct) 542 that sends in air are provided respectively on the upper side and at the lower side of developing unit 534, as shown in FIG. 3, an air current that flows from the exhaust duct to the suction duct is formed near a portion (developing nip portion) where the developing unit faces photoreceptor (image carrier) 531, and toner scattering from the developing unit is controlled by an air curtain and scattered toner is collected (for example, see Unexamined Patent Application Publication No. 11-327295).

However, in the aforesaid technologies, although there is an effect for cooling of developing roller 541, temperature rise in the apparatus caused by speeding up of the apparatus and temperature rise in the developing unit caused by heat of compression (generation of heat by stress) of developing agents compressed by developer regulating plate 543 in the developing unit, especially by an increase of a rotation rate of a developing roller, have become a problem. Further, in the air flow in the technology in Unexamined Patent Application Publication No. 11-327295, scattered toner sticks to the developer regulating plate to disturb a flow of developing agents.

SUMMARY OF THE INVENTION

An object of the invention is to cool a developer regulating plate and a developing roller, to prevent sticking of toner to the developer regulating plate and to provide an image forming apparatus capable of coping with speeding up.

The object of the invention mentioned above are attained by an image forming apparatus having the following constructions including an image carrier, a developer carrier that is arranged to face the image carrier and thereby to form a developing nip portion, and carries developer containing toner for developing a latent image formed on the image carrier, a developing unit having a developer regulating member that regulates a thickness of a layer of the developer carried on the developer carrier, an air sending duct having an air sending path that is provided on the developing unit and sends air to the developer carrier and a suction duct having a suction path that is provided on the developing unit and sucks air from the developer carrier, wherein the developer regulating member is arranged on the air sending duct side, and the air sending path and the suction path are arranged to be connected by forming a space surrounded by a surface of the developer carrier, the developer regulating plate and a wall forming the suction path.

DETAILED DESCRIPTION OF THE PREFERRED EMBODIMENT

Figure 1:
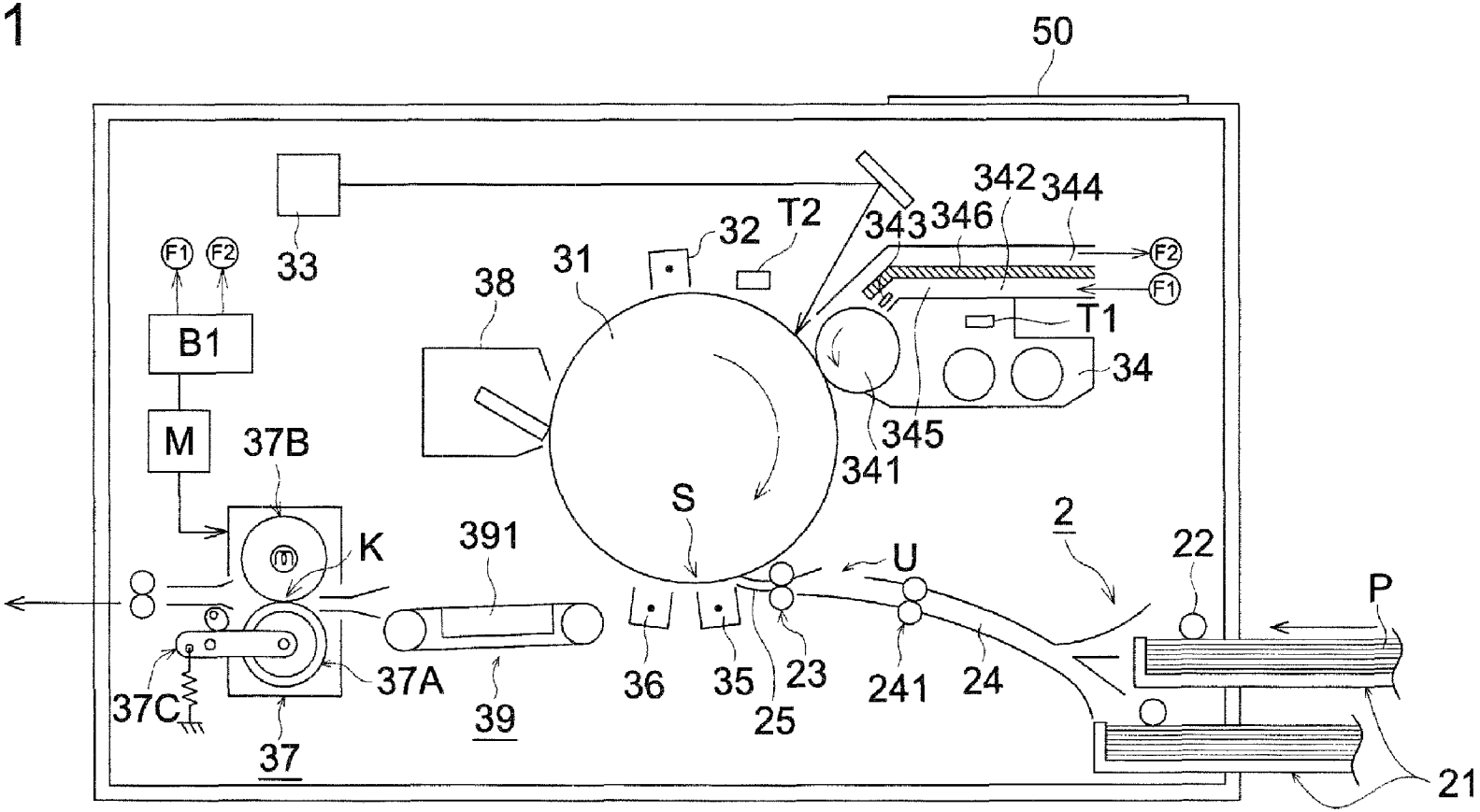
FIG. 1 is a schematic sectional view of an image forming apparatus relating to the invention.

An example of an embodiment relating to the invention will be explained as follows, referring to the drawings, in which the technical scope of the invention is not limited by terminologies used in the present specifications.

FIG. 1 is a schematic sectional view of an image forming apparatus relating to the invention.

In FIG. 1, photoreceptor drum 31 representing an image carrier is given rotative force by an unillustrated drum driving section that is driven by instructions of control section B1 representing a control device, to be driven to rotate in a direction of arrow.

The photoreceptor drum 31 is surrounded by charging unit 32, writing device 33, developing unit 34, transfer unit 35, separating unit 36 and cleaning device 38, in this order from the upstream side in the rotative direction of the photoreceptor drum 31. Owing to this, image-wise exposure of a document (latent image formation) is conducted on the photoreceptor drum 31 through charging with electricity by charging unit 32 and through writing with the writing device 33, and the latent image is developed by developing roller 341 of developing unit 34. Namely, toner sticks to the latent image and then, the latent image is visualized to become a toner image.

Meanwhile, in the vicinity of developing unit 34, there are arranged a scattering duct that collects scattered toner and a cooling duct both relating to the invention.

On the other hand, sheet P representing a transfer material is fed out by feed out roller 22 from sheet feed tray 21 of sheet feed device 2, then, it passes through conveyance path 24 and conveyance paired rollers 241 to arrive at timing roller 23 to stop there temporarily where a skew of the leading edge of the sheet P is corrected, and the sheet P forms a loop at opening portion U.

After that, the sheet P is synchronized with the toner image on photoreceptor drum 31, and is guided, from entrance guide plate 25 to transfer area S, by the timing roller 23 when it is driven again. In the transfer area S, a toner image is transferred onto sheet P by transfer unit 35 on which the voltage with polarity opposite to that of toner is applied, and the sheet P is separated from photoreceptor drum 31 by separation unit 36.

The sheet P thus separated is conveyed by conveyance belt 39 having in its inside air suction box 391, to advance to fixing unit 37. After that, pressure roller 37A provided inside fixing unit 37 and heat roller 37B representing a fixing roller are caused to be in the state of pressure contact by pressure contact mechanism 37C, and the sheet P carrying a toner image is pressed and heated at nip portion K formed, thus, the toner image is fixed on the sheet P.

The photoreceptor drum 31 after transferring is cleaned by cleaning device 38 to be ready for the succeeding image forming. These operations of charging unit 32 to fixing unit 37 and air blast adjustment for the aforesaid scattering duct and the cooling duct are controlled by control section B1 representing a control device.

The suction duct and the air sending duct relating to the invention will be explained as follows.

An amount of toner used has been increased by spread of colorization and speeding up for image forming, as stated before, and thereby, members in the apparatus relating to image forming are soiled by scattered toner to increase frequency of adverse effects on image quality. Further, there have been brought a problem of a temperature rise in the apparatus caused by speeding up, especially, of a temperature rise caused by heat that is generated by stress of a developer originating from compression and regulation inflicted on the developer conveyed through a developer unit by a developer regulating plate which are caused by an increased speed of rotation of a developing roller.

The invention makes it possible to suppress contamination in the apparatus caused by scattered toner and temperature rise of a developing unit and in the apparatus, and to maintain stable image quality.

Figure 2:
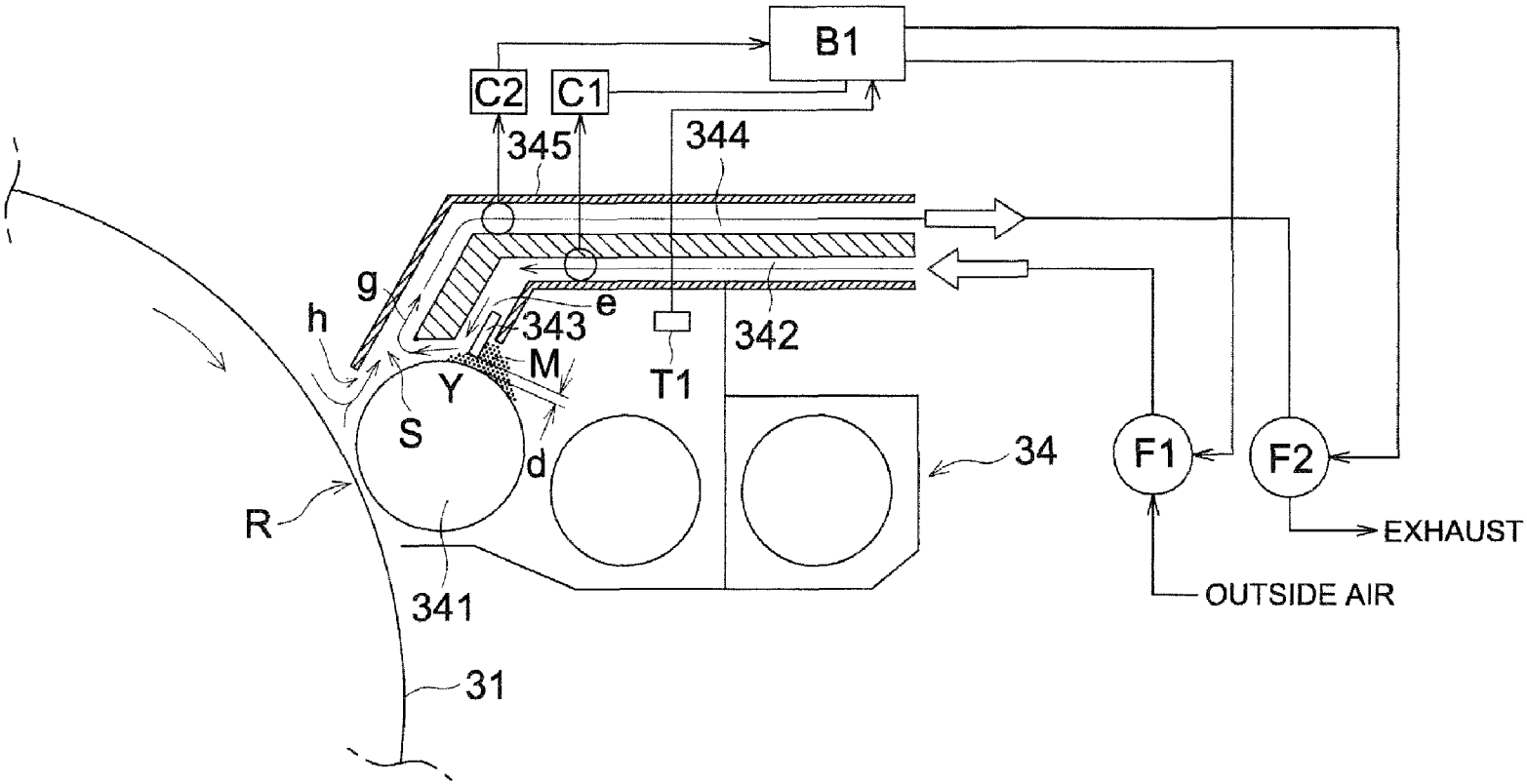
FIG. 2 is a diagrammatic sketch of an enlarged cross section of the portion near a developing unit shown in FIG. 1.

FIG. 2 is a diagrammatic sketch in which the neighborhood of a developing unit shown in FIG. 1 is enlarged.

In FIG. 2, air sending duct 342 has an exhaust port "e" in the longitudinal direction on the surface of developing roller 341 that is a developer carrier, and a part of developer regulating plate 343 is covered by the exhaust port "e" along the duct. Both ends of the developer regulating plate 343 in its longitudinal direction are supported by unillustrated supporting members to cross the inside of the exhaust port "e" on the air sending duct 342 side, while keeping prescribed clearance "d" from the developing roller 341. On an image forming apparatus main body (which is simply called an apparatus main body hereinafter), there is provided an unillustrated intake for outside air that is connected with the air sending duct 342 through suction fan F1. Therefore, the developer regulating plate 343 is cooled by an air flow running through the air sending duct 342, and sticking toner is removed.

Further, between exhaust port "e" of air sending duct 342 (or developer regulating plate 343) and developing nip portion R, there is located suction port "g" of suction duct 344, and the exhaust port "e" is connected with the suction port "g", along a surface of developing roller 341, through space S that is surrounded by a surface of developing roller 341, developer regulating plate 343 and by suction path wall 345 that forms the suction path 344. Therefore, outside air coming from the exhaust port "e" flows to the suction port "g" along the surface of developing roller 341, thus, a developer and the surface of developing roller 341 are cooled accordingly. Further, on the side of the photoreceptor drum 31 beyond the suction port "g", there is constructed opening portion "h" between an extended portion of suction duct 344 and developing roller 341, and scattered toner generated in the neighborhood of developing nip portion R is drawn in suction duct 344.

Air quantity in air sending duct 342 and that in suction duct 344 are measured respectively by air speedometers C1 and C2 through air quantity detection members, and their data are transmitted to control section B1 representing a control device.

Temperature sensor T1 is arranged in developing unit 34, and data detected thereby are transmitted to control section B1. Based on the data, a speed of rotation of suction fan F1 and that of exhaust fan F2 are controlled so that a blast (air) quantity in the duct is increased or decreased, whereby, cooling of a developer regulating plate and collection of scattered toner are carried out.

Therefore, air coming from fan F1 passes through air sending duct 342 to cool the aforesaid developer regulating plate 342 at exhaust port "y" and to cool also compressed developer M at the upstream side.

Further, air cools a surface of developing roller 341 and regulated developer while flowing, and after cooling, the air sucks toner scattered from developing nip portion R from suction port "g", and is absorbed to suction duct 344.

Figure 3:
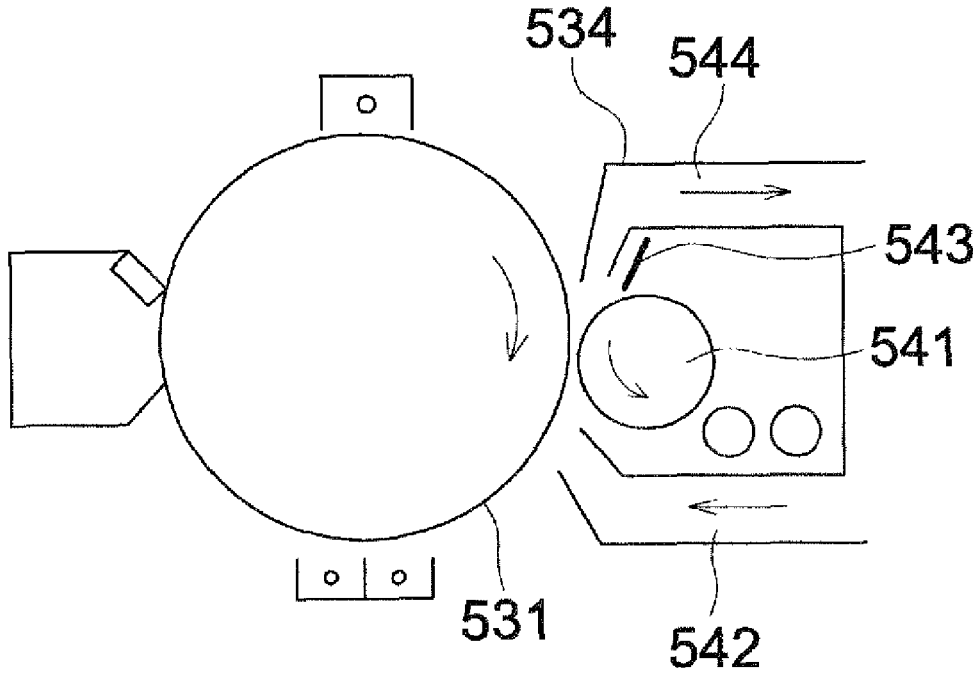
FIG. 3 is a diagram showing a prior art of a suction duct and an exhaust duct.

Table 1 shows results of the experiments of cooling effects and effects of prevention of toner scattering which were made for the embodiment of the invention (see FIG. 2) and a comparative example (see FIG. 3).

TABLE 1

| Developing duct constitution | Suction duct wind speed | Air duct wind speed | Toner scattering | Temperature rise in developing unit |
|---|---|---|---|---|
| Comparative Example (FIG. 3) | 0.7 | 0.6 | YES | 15 |
| Embodiment (FIG. 2) | 0.7 | 0.6 | NO | 12 |

In Table 1, when an air sending duct wind speed is set to 0.6 m/sec and a suction duct wind speed is set to 0.7 m/sec for both the comparative example and the embodiment, it was possible to confirm that an effect of the embodiment is better on the points of toner scattering and a temperature rise (in the developing unit).

By providing an air sending path to send cool air at the position of the developer regulating plate as mentioned above, it is possible to suppress a temperature rise in the developing unit and thereby to prevent image inferiority caused by a temperature rise, and to prevent that scattered toner sticks to the developer regulating plate.

What is claimed is:

1. An image forming apparatus comprising:

(a) an image carrier on which a latent image is formed;

(b) a developing unit comprising a developer carrier arranged to face the image carrier and to form a developing nip portion therewith, which carries a developer including a toner that develops the latent image, and a developer regulating member that regulates a layer thickness of the developer carried on the developer carrier;

(c) an air sending duct having an air sending path provided in the developing unit, which sends air to the developer carrier; and (d) a suction duct having a suction path provided in the developing unit, which sucks air from the developer carrier, wherein the developer regulating member is arranged on a side of the air sending duct, and the air sending path and the suction path are arranged to be connected with each other by forming a space surrounded by a surface of the developer carrier, the developer regulating member and a wall forming the suction path.

2. The image forming apparatus of claim 1, wherein the air sending path of the air sending duct is arranged so that an exhaust port of the air sending duct covers a part of the developer regulating member.

3. The image forming apparatus of claim 1, wherein the developing unit further comprises a temperature sensor provided inside the developing unit, which detects a temperature inside thereof, and wind velocity in the air sending duct and the sucking duct is controlled according to the detected temperature by rotation speeds of fans each of which is connected to the air sending duct and the suction duct, respectively.

* * * * *